US007114602B2

(12) United States Patent
Chen

(10) Patent No.: US 7,114,602 B2
(45) Date of Patent: Oct. 3, 2006

(54) MULTIPLE FUNCTION LUGGAGE

(76) Inventor: Po-Cheng Chen, No. 66, Sec. 4, Chung-Ching N. Road, Taipei (TW)

( * ) Notice: Subject to any disclaimer, the term of this patent is extended or adjusted under 35 U.S.C. 154(b) by 192 days.

(21) Appl. No.: 10/752,558

(22) Filed: Jan. 8, 2004

(65) Prior Publication Data

US 2005/0150733 A1 Jul. 14, 2005

(51) Int. Cl.
*A45C 9/00* (2006.01)
*A45C 5/14* (2006.01)
*A45C 13/26* (2006.01)

(52) U.S. Cl. ..... 190/11; 190/18 A; 190/39; 190/115; 16/110.1; 16/113.1; 383/4

(58) Field of Classification Search ..... 190/10, 190/11, 12 A, 18 A, 39, 115, 1, 8; 108/15; 206/320; 16/111.1, 113.1, 114.1, 110.1; 383/4

See application file for complete search history.

(56) References Cited

U.S. PATENT DOCUMENTS 3,446,304 A * 5/1969 Alimanestiand ..... 180/9.23
4,564,091 A * 1/1986 Coneglio ..... 190/11
5,330,037 A * 7/1994 Wang ..... 190/18 A
5,437,367 A * 8/1995 Martin ..... 206/320
5,645,146 A * 7/1997 Bieber et al. ..... 190/18 A
5,690,196 A * 11/1997 Wang ..... 190/115
5,706,921 A * 1/1998 Wang ..... 190/115
5,941,352 A * 8/1999 Lee ..... 190/11
6,105,508 A * 8/2000 Ryburg ..... 108/42
6,213,265 B1 * 4/2001 Wang ..... 190/11
6,301,749 B1 * 10/2001 Chen ..... 16/429
6,464,245 B1 * 10/2002 Miles ..... 280/655.1
6,471,019 B1 * 10/2002 Miller ..... 190/11

* cited by examiner

*Primary Examiner*—Sue A. Weaver
(74) *Attorney, Agent, or Firm*—Rabin & Berdo, P.C.

(57) ABSTRACT

A carry-on luggage includes a casing having wheels rotatably mounted on a side face of the casing to allow the casing to move freely, a first recessed area defined in the side face thereof and a second recessed area defined in a side face of the casing to communicate with the first recessed area, a main board provided with a third recessed area, and a first and a second auxiliary handles securely and slidably received in the third recessed area to be able to extend out of the main board. The second auxiliary handle is able to extend out of the third recessed area and the first auxiliary handle is able to extend out of the third recessed area only when the main board is extended out of the first recessed area and pivoted relative to the casing.

20 Claims, 6 Drawing Sheets

MULTIPLE FUNCTION LUGGAGE

BACKGROUND OF THE INVENTION

1. Field of the Invention

The present invention relates to a luggage, and more particularly to a multiple function luggage having a handle extendable and rotatable relative to the casing and provided with a first auxiliary handle slidably received in a first side of the handle and a second auxiliary handle slidably received in a second side of the handle opposite to the first auxiliary handle such that the operator is able to use the first or the second auxiliary handle to carry the casing depending on the weight of the casing.

2. Description of Related Art

A carry-on luggage usually is equipped with an extendable handle and wheels so that the operator is able to easily carry the luggage to places as desired. When the handle is not in use, the operator is able to retract the handle in a pair of slots defined in a rear side of the luggage. Although the carry-on luggage does provide easy transportation for the operator, the handle is easily damaged because the strength of the handle is not enough especially when the load of the luggage is too much. Therefore, another drawback of this luggage is that there is no mechanism to cope with the weight of the luggage.

Even though the strength of the handle is enough to deal with the luggage weight, the handle length is fixed, which does not fit to operators of different heights. Therefore, some operators will have to use different and strange positions to carry the luggage.

To overcome the shortcomings, the present invention intends to provide an improved carry-on luggage to mitigate the aforementioned problems.

SUMMARY OF THE INVENTION

The primary objective of the invention is to provide an improved luggage having a main board extendable and rotatable relative to the casing of the luggage, a first auxiliary handle extendable to the main board and a second auxiliary handle extendable to the main board so that the operator is able to extend the main board, the first auxiliary handle or the second auxiliary handle to carry the casing depending on the weight of the luggage.

Another objective of the invention is to introduce a luggage having a main board, a first auxiliary handle and a second auxiliary handle, which are able to form a platform to allow the operator to work on the platform.

Other objects, advantages and novel features of the invention will become more apparent from the following detailed description when taken in conjunction with the accompanying drawings, in which:

DETAILED DESCRIPTION OF PREFERRED EMBODIMENT

Figure 1:
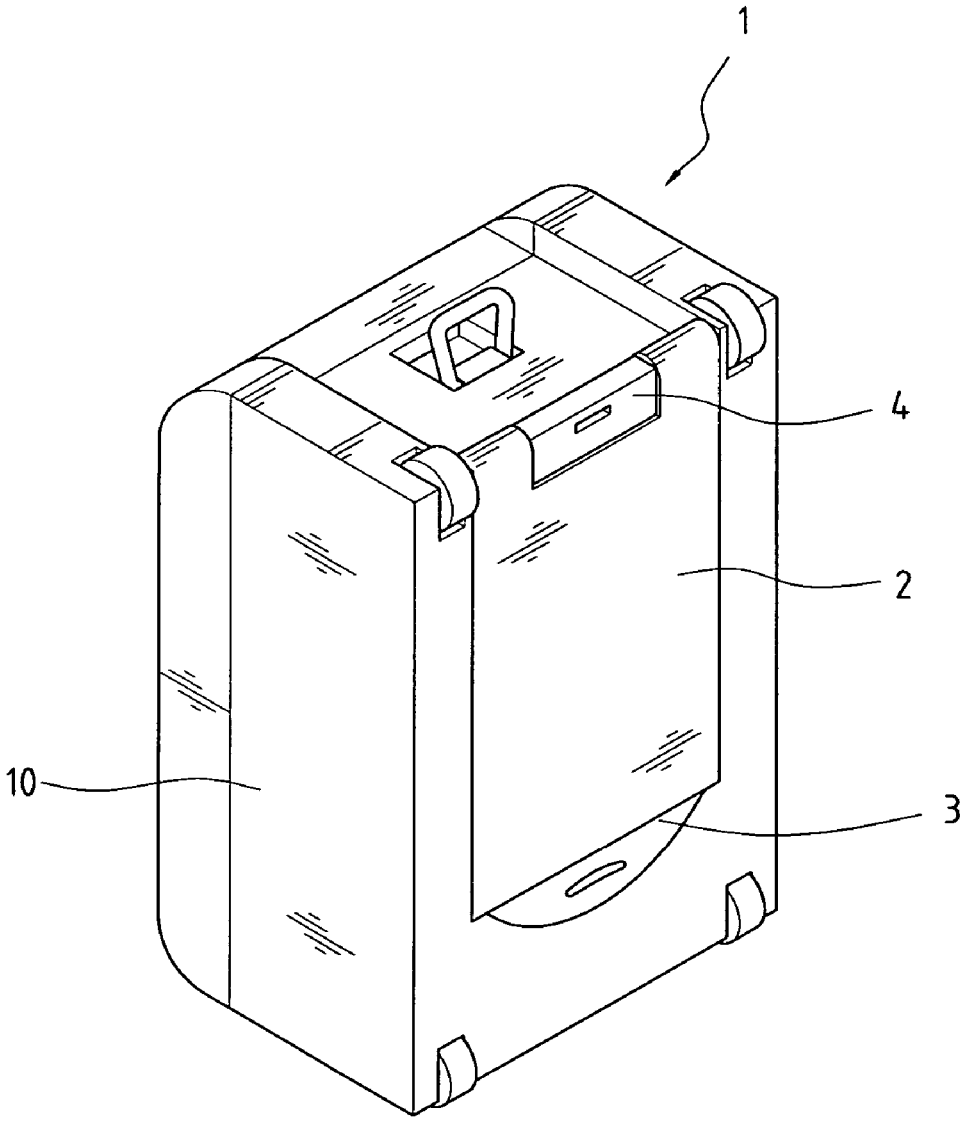
FIG. 1 is perspective view of a luggage constructed in accordance with the present invention.
Figure 2:
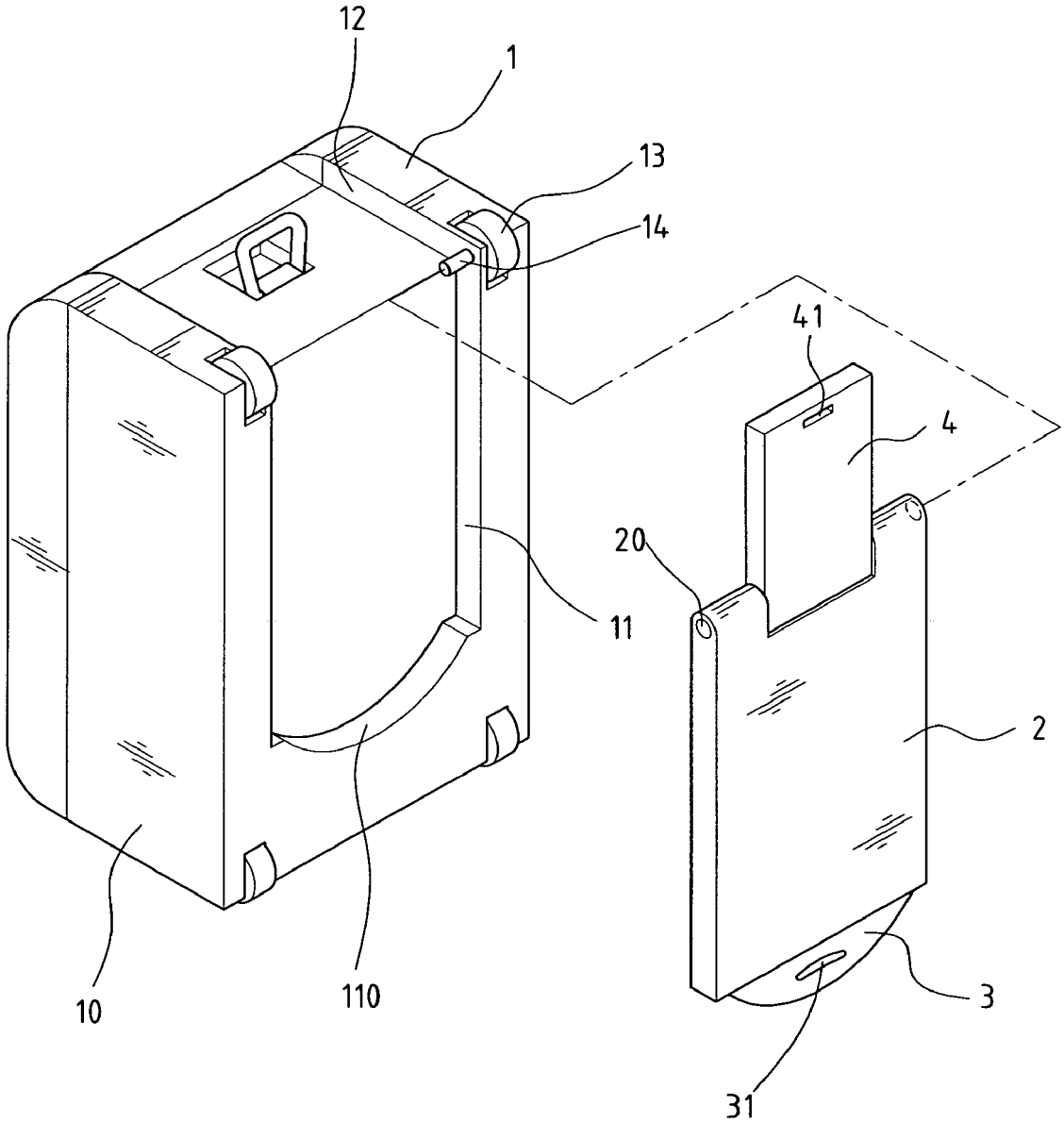
FIG. 2 is an exploded perspective view of the luggage of the present invention.
Figure 3:
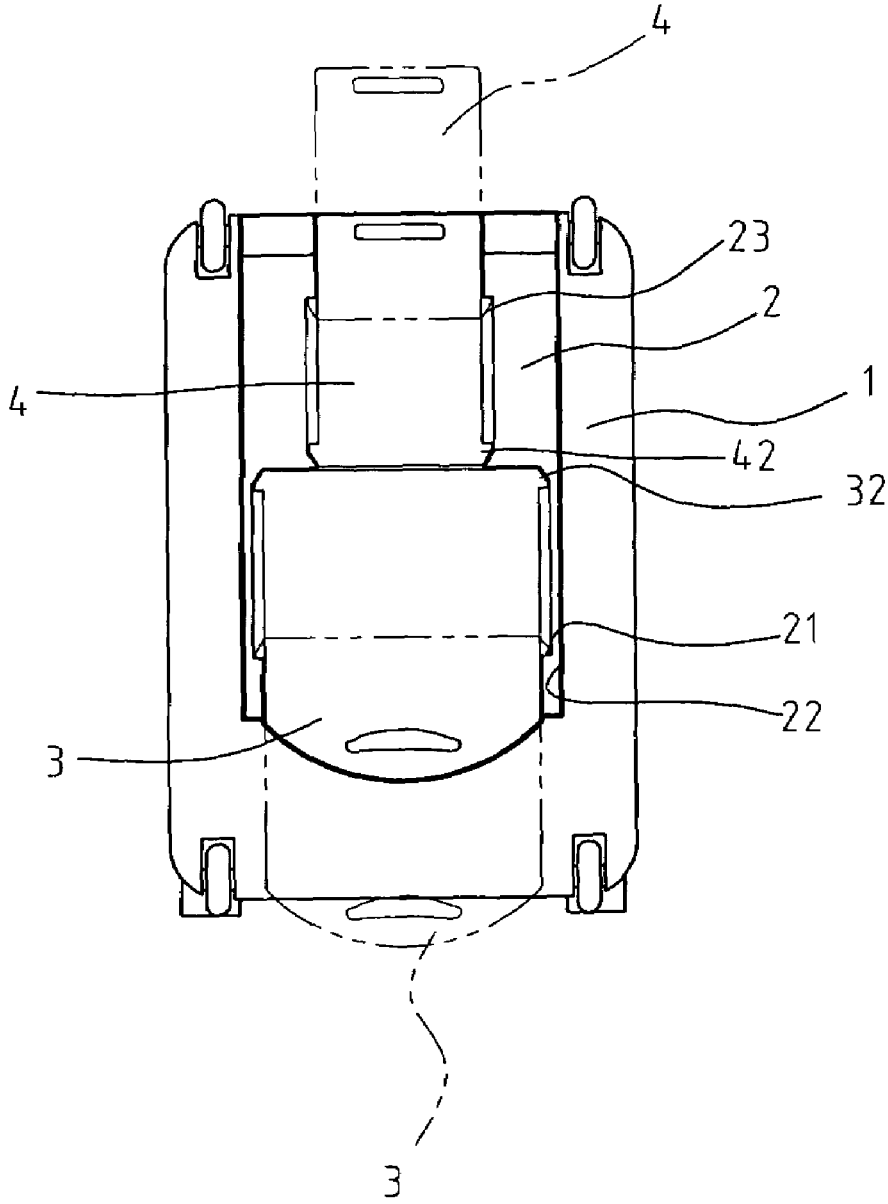
FIG. 3 is a rear side plan view of the luggage in FIG. 1.

With reference to FIGS. 1, 2 and 3, a luggage 1 constructed in accordance with the present invention comprises a casing 10, a main board 2, a first auxiliary handle 3 and a second auxiliary handle 4.

The casing 10 defines a first recessed area 11 is a rear side of the casing 10 and a second recessed area 12 defined in a top side of the casing 10 to communicate with the first recessed area 11. Wheels 13 are rotatable mounted on corners of the rear side of the casing 10 to allow the casing 10 to be towed easily. An arcuate side face 110 is defined in a side face defining the first recessed area 11. Two pivots 14 are oppositely formed on a joint between the rear side and the top side of the casing 10.

The main board 2 is received in the first recessed area 11 and has two pivot holes 20 respectively and oppositely defined in a side face of the main board 2 to correspond to the two pivots 14. The main board 2 defines in a rear side face a third recessed area 22 with two open ends and has a first stop 21 formed on opposite side faces defining the third recessed area 22 and a second stop 23 formed on opposite side faces defining the third recessed area 22 and opposite relative to the first stop 21. Due to the corresponding relationship between the pivot holes 20 and the two pivots 14, the main board 2 is rotatable for an angle of up to 270 degrees relative to the casing 10.

The first auxiliary handle 3 is securely and slidably received in the third recessed area 22 and has a first holding hole 31 defined through the first auxiliary handle 3 and a stop 32 oppositely formed on a side face of the first auxiliary handle 3 to correspond to the stop 21 of the main board 2. Thus the stop 21 of the main board 2 is able to engage with the stop 32 of the first auxiliary handle 3 to prevent excessive movement of the first auxiliary handle 3 relative to the main board 2.

The second auxiliary handle 4 is securely and slidably received in the third recessed area 22 and has a second holding hole 41 defined through the second auxiliary handle 4 to allow the operator to hold the second auxiliary handle 4 and a stop 42 oppositely formed on a side face of the second auxiliary handle 4 to correspond to the second stop 23 of the main board 2. Thus the movement of the second auxiliary handle 4 relative to the main board 2 is limited. It is noted from FIG. 3 again that after the first auxiliary handle 3 and the second auxiliary handle 4 are received in the third recessed area 22 of the main board 2, the first auxiliary handle 3 is able to extend out of one of the open ends and the second auxiliary handle 4 is able to extend out of the other one of the open ends of the main board 2. However, because the arcuate side 110 of the first recessed area 11 limits the movement of the first auxiliary handle 3, the first auxiliary handle 3 is not able to extend out of the first recessed area 11 as long as the main board 2 is received in the first recessed area 11. Yet, because there is no limitation to the movement of the second auxiliary handle 4, the second auxiliary handle 4 is able to freely extend out of the first recessed area 11 and the main board 2.

Figure 4:
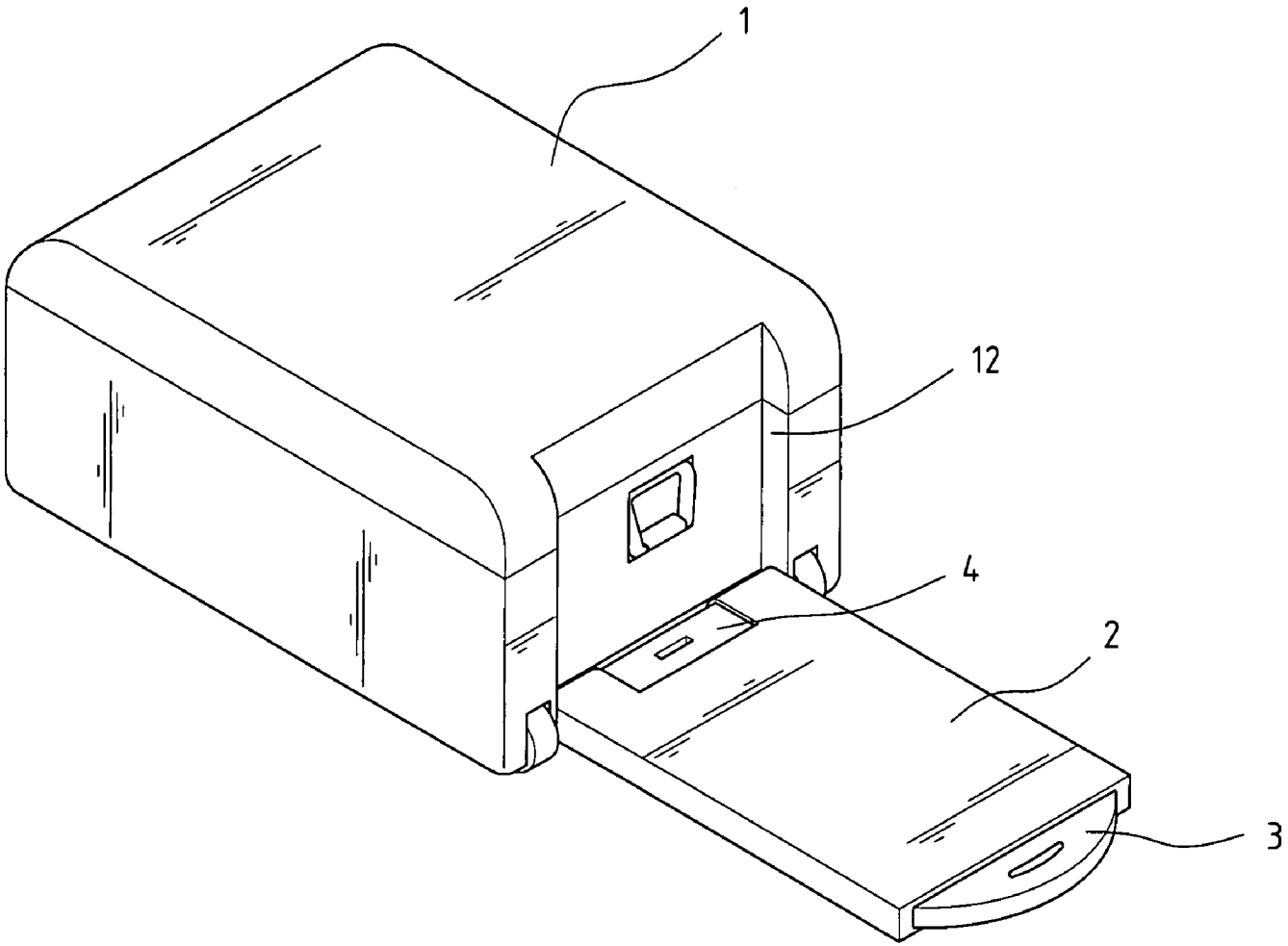
FIG. 4 is a perspective view showing that a main board is extended.
Figure 5:
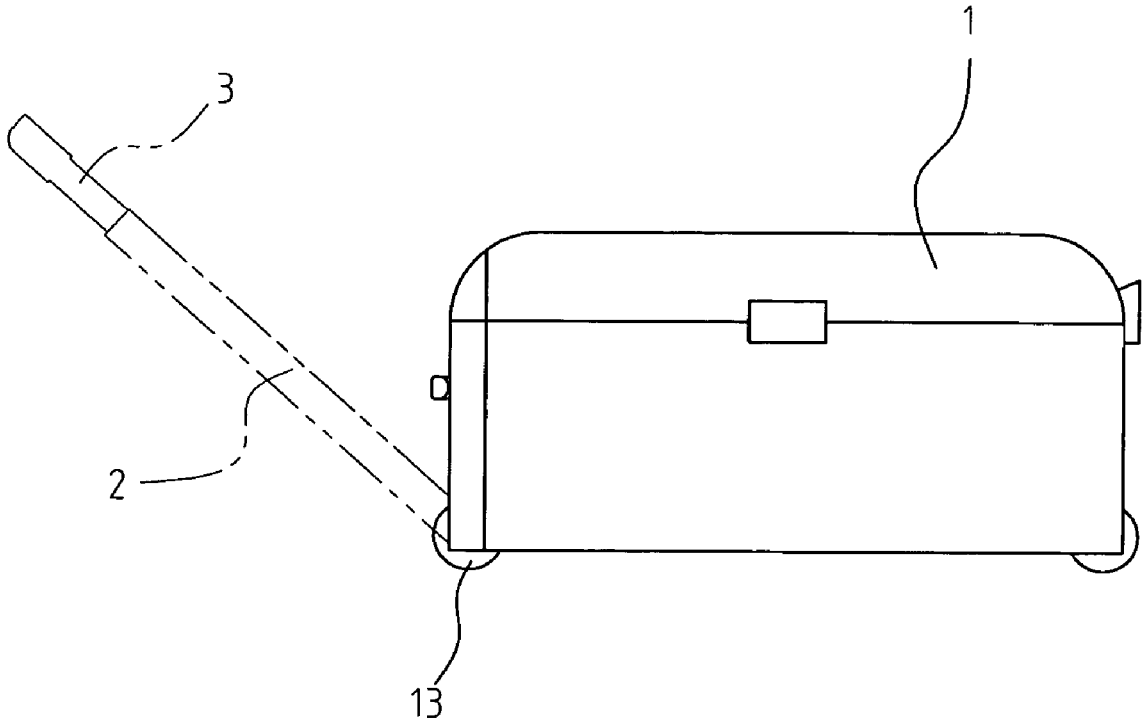
FIG. 5 is a schematic side plan view showing that a first auxiliary handle is extended while the main board is extended.

With reference to FIGS. 4 and 5, when the luggage of the present invention is in application and there is a load inside the casing 10, the operator is able to lay the luggage down on the ground first. Then the second auxiliary handle 4 is able to extend out of the third recessed area 22 until the engagement between the stop 42 and the second stop 23 limits the movement of the second auxiliary handle 4. If the load inside the casing 10 is too large and the operator has a height higher than a height of the operator using the second auxiliary handle 4, the operator is able to extend the main board 2 out of the first recessed area 11 and pivot the main board 2. After the pivotal movement of the main board 2, the first auxiliary handle 3 is able to extend out of the third recessed area 22 to allow the operator to have a comfortable position to carry the casing 10. Furthermore, because the first auxiliary handle 3 has a dimension larger than a dimension of the second auxiliary handle 4, the first auxiliary handle 3 is able to carry a load larger than the load of the second auxiliary handle 4.

Figure 6:
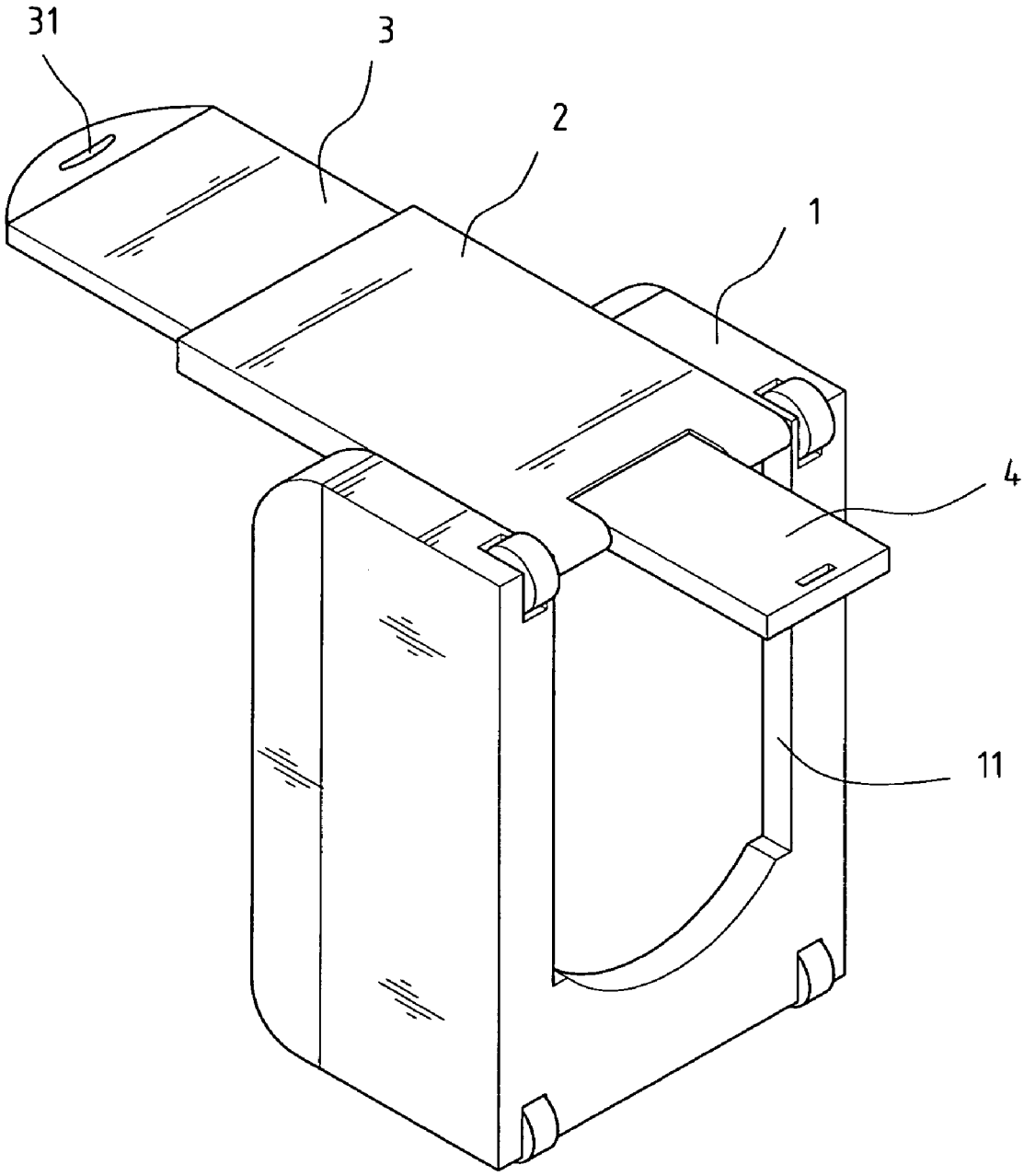
FIG. 6 is a perspective view showing that after the main board, the first auxiliary handle and a second auxiliary handle are extended and the main board is supported by a side of the casing, a platform is formed to allow the operator to work thereon.

With reference to FIG. 6, when the operator is in waiting of a train, a plane or a bus, or even the operator is trying to work on a work site with his/her tool kit stored in the casing 10, the operator is able to stand upright the casing 10 and extend the main board 2 out of the first recessed area 11 and receive the main board 2 in the second recessed area 12. Then extending both the first and second auxiliary handles 3,4 is able to form a platform. Thereafter, the operator is able to use the platform composed of the main board 2, the first auxiliary handle 3 and the second auxiliary handle 4 to support a laptop computer or anything suitable.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A carry-on luggage, comprising:

a casing having wheels rotatably mounted on a side face of the casing to allow the casing to move freely, a first recessed area defined in the side face thereof and a second recessed area defined in another side face of the casing to communicate with the first recessed area;

a main board pivotally attached to said casing at an upper end thereof, and being receivable in the first recessed area, and provided with a third recessed area in a rear side face of the main board relative to the casing, wherein the third recessed area has a first open end disposed at a lower end of the main board, and a second open end disposed at the upper end of said main board;

a first auxiliary handle securely and longitudinally slidably received in the third recessed area to be able to extend out of the first open end of the main board; and a second auxiliary handle securely and longitudinally slidably received in the third recessed area to be able to extend out of the second open end of the main board, wherein both the second auxiliary handle and the first auxiliary handle are able to simultaneously extend out of the third recessed area only when the main board is extended out of the first recessed area and pivoted relative to the casing; and wherein when both the second auxiliary handle and the first auxiliary handle are simultaneously extended, the second auxiliary handle, the first auxiliary handle and the main board collectively form a table that rests in the second recessed area defined in the another side face of the casing.

2. The luggage as claimed in claim 1, wherein two pivots each are oppositely formed on a joint between the first recessed area and the second recessed area to correspond to two pivot holes each defined in opposite side faces of the main board such that the main board is able to pivot relative to the casing after the main board is extended out of the first recessed area.

3. The luggage as claimed in claim 1, wherein the first recessed area has an arcuate side formed on a side face defining the first recessed area to mate with a side face of the first auxiliary handle such that the first auxiliary handle is securely received in the first recessed area.

4. The luggage as claimed in claim 2, wherein the first recessed area has an arcuate side formed on a side face defining the first recessed area to mate with a side face of the first auxiliary handle such that the first auxiliary handle is securely received in the first recessed area.

5. The luggage as claimed in claim 1, wherein the main board is rotatable relative to the casing for an angle up to 270 degrees.

6. The luggage as claimed in claim 2, wherein the main board is rotatable relative to the casing for an angle up to 270 degrees.

7. The luggage as claimed in claim 4, wherein the main board is rotatable relative to the casing for an angle up to 270 degrees.

8. The luggage as claimed in claim 1, wherein the third recessed area has a first stop formed on opposite sides defining the third recessed area to correspond to a first stop formed on opposite sides of the first auxiliary handle such that movement of the first auxiliary handle is limited.

9. The luggage as claimed in claim 2, wherein the third recessed area has a first stop formed on opposite sides defining the third recessed area to correspond to a first stop formed on opposite sides of the first auxiliary handle such that movement of the first auxiliary handle is limited.

10. The luggage as claimed in claim 4, wherein the third recessed area has a first stop formed on opposite sides defining the third recessed area to correspond to a first stop formed on opposite sides of the first auxiliary handle such that movement of the first auxiliary handle is limited.

11. The luggage as claimed in claim 7, wherein the third recessed area has a first stop formed on opposite sides defining the third recessed area to correspond to a first stop formed on opposite sides of the first auxiliary handle such that movement of the first auxiliary handle is limited.

12. The luggage as claimed in claim 1, wherein the third recessed area has a stop formed on opposite sides defining the third recessed area to correspond to a second stop formed on opposite sides of the second auxiliary handle such that movement of the second auxiliary handle is limited.

13. The luggage as claimed in claim 8, wherein the third recessed area has a second stop formed on opposite sides defining the third recessed area to correspond to a second stop formed on opposite sides of the second auxiliary handle such that movement of the second auxiliary handle is limited.

14. The luggage as claimed in claim 9, wherein the third recessed area has a second stop formed on opposite sides defining the third recessed area to correspond to a second stop formed on opposite sides of the second auxiliary handle such that movement of the second auxiliary handle is limited.

15. The luggage as claimed in claim 10, wherein the third recessed area has a second stop formed on opposite sides defining the third recessed area to correspond to a second stop formed on opposite sides of the second auxiliary handle such that movement of the second auxiliary handle is limited.

16. The luggage as claimed in claim 11, wherein the third recessed area has a second stop formed on opposite sides defining the third recessed area to correspond to a second stop formed on opposite sides of the second auxiliary handle such that movement of the second auxiliary handle is limited.

17. The luggage as claimed in claim 13, wherein the first auxiliary handle has a first holding hole defined through the first auxiliary handle and the second auxiliary handle has a second holding hole defined through the second auxiliary handle.

18. The luggage as claimed in claim 14, wherein the first auxiliary handle has a first holding hole defined through the first auxiliary handle and the second auxiliary handle has a second holding hole defined through the second auxiliary handle.

19. The luggage as claimed in claim 15, wherein the first auxiliary handle has a first holding hole defined through the first auxiliary handle and the second auxiliary handle has a second holding hole defined through the second auxiliary handle.

20. The luggage as claimed in claim 16, wherein the first auxiliary handle has a first holding hole defined through the first auxiliary handle and the second auxiliary handle has a second holding hole defined through the second auxiliary handle.

* * * * *